United States Patent [19]

Chloupek et al.

[11] 4,039,300

[45] Aug. 2, 1977

[54] GASOLINE FUEL COMPOSITION AND METHOD OF USING

[75] Inventors: Frank J. Chloupek, South Holland; Tai S. Chao, Homewood, both of Ill.

[73] Assignee: Atlantic Richfield Company, Philadelphia, Pa.

[21] Appl. No.: 475,373

[22] Filed: June 3, 1974

[51] Int. Cl.[2] ..... C10L 1/22

[52] U.S. Cl. ..... 44/58

[58] Field of Search ..... 44/58

[56] References Cited

U.S. PATENT DOCUMENTS

| | | | |
|---|---|---|---|
| 3,219,666 | 11/1965 | Norman et al. | 44/58 |
| 3,438,757 | 4/1969 | Honnen et al. | 44/58 |
| 3,717,446 | 2/1973 | Howland et al. | 44/58 |

*Primary Examiner*—Daniel E. Wyman
*Assistant Examiner*—Mrs. Y. Harris-Smith
*Attorney, Agent, or Firm*—Frank J. Uxa

[57] ABSTRACT

An improved composition for fueling an internal combustion engine equipped with at least one carburetor which comprises a major amount of hydrocarbons boiling in the gasoline boiling range, a minor amount of at least one detergent, and a minor amount of mineral oil of lubricating viscosity comprising at least about 50% by weight of aromatic hydrocarbons having an average molecular weight in the range from about 300 to about 700 the detergent and oil both being present in the composition in amounts sufficient to inhibit formation of deposits on the carburetor.

An improved method for fueling such an engine using the composition described above is also disclosed.

22 Claims, No Drawings

GASOLINE FUEL COMPOSITION AND METHOD OF USING

This invention relates to an improved motor fuel composition for an internal combustion engine. More particularly, the invention relates to a motor fuel composition effective to inhibit the formation of harmful deposits, for example, on the carburetor and associated components, e.g., exhaust gas recycle system as well as on or around the intake valves of an internal combustion engine.

Internal combustion engines are often subject to a substantial build-up of hard, tenacious deposits on the carburetor and associated components, e.g., exhaust gas recycle system, on intake valves and intake ports of the engine. This deposit problem has been aggravated in recent years by the wide spread use of exhaust gas recycle to, for example, reduce harmful exhaust gas emissions. These deposits often interfere with the operation of the fuel intake system. As the deposit level grows, the engine may exhibit increases in fuel consumption and exhaust emissions, loss of power, rough idling and, occasionally, valve burning. When the deposits become excessive, portions may break off and be drawn into the engine's combustion chambers. Instances of mechanical damage to the piston and piston rings caused by these deposits have been observed. Therefore, it would be advantageous to inhibit the formation of such deposits.

One of the objects of the present invention is to provide a motor fuel composition for an internal combustion engine effective to inhibit the formation of harmful deposits on the carburetor and associated components of the internal combustion engine.

Another object of the present invention is to provide a method for fueling an internal combustion engine wherein formation of harmful deposits on the carburetor and associated components is inhibited. Other objects and advantages of the present invention will become apparent hereinafter.

An improved composition for fueling an internal combustion engine equipped with at least one carburetor has now been discovered. The composition comprises a major amount of hydrocarbons boiling in the gasoline boiling range, a minor amount of at least one detergent, and a minor amount of mineral oil of lubricating viscosity comprising at least about 50% by weight of aromatic hydrocarbons having an average molecular weight in the range from about 300 to about 650, the detergent and oil both being present in the composition in amounts sufficient to inhibit formation of deposits on the carburetor. Thus, it has been found that minor amounts of both at least one aromatic-rich mineral oil fraction of lubricating viscosity and at least one detergent in a motor fuel composition provide improved inhibition to the formation of deposits on the carburetor and associated components of an internal combustion engine. These compositions may be used in an improved method of fueling an internal combustion engine equipped with at least one carburetor to achieve outstanding benefits, e.g., reduced deposit formation on the carburetor and/or associated engine components such as the exhaust gas recycle entry system.

The nature of the aromatic-rich mineral oil fraction suiable for use in the present motor fuel composition is such that it contains at least about 50%, and preferably at least about 60%, by weight of aromatic hydrocarbons. By "aromatic hydrocarbons" is meant those compounds which include at least one aromatic ring. The average molecular weight of these aromatic hydrocarbons is often in the range from about 300 to about 700 preferably from about 350 to about 650. Typically, these mineral oil fractions are of a lubricating viscosity, for example, from about 40 SUS to about 3200 SUS, preferably from about 65 SUS to about 1000 SUS, at 210° F. Suitable mineral oil fractions for use in the present invention are often derived from petroleum and can be produced using conventional methods well known in the art. To illustrate, a petroleum crude oil, preferably a low sulfur crude oil, e.g., containing less than about 1% by weight of sulfur, such as those found in West Texas, North West Oklahoma and Canada, is fractionally distilled. A lube distillate fraction, typically boiling primarily in the range from about 500 to about 950° F., and a crude oil residuum are thus formed. The residuum can be treated, for example, with propane, to remove asphaltic components from the residuum. The lube distillate and/or deasphalted fraction may be extracted with, for example, phenol, to separate this materia! into a raffinate which is often rich in paraffins and a mineral oil fraction enriched in aromatic hydrocarbons relative to the extraction feedstock. At least a portion of this aromatic-enriched mineral oil fraction can be used in the motor fuel composition of the present invention.

As noted above, the mineral oil fraction is present in the fuel composition in combination with at least one detergent in an amount sufficient to provide improved inhibition to the formation of deposits on the carburetor and associated components, e.g., exhaust gas recycle system, of an internal combustion engine. Preferably, the mineral oil fraction is present in an amount equal to at least about 50 pounds of oil per 1000 barrels of fuel composition. Often, this mineral oil is present in an amount from about 100 to about 1000 pounds of oil per 1000 barrels of fuel composition. More preferably, the fuel composition of the present invention comprises from about 150 to about 400 pounds of aromatic-rich mineral oil fraction per 1000 barrels of fuel composition.

The motor fuel compositions of the present invention include at least one detergent. In general, the suitable detergents may be characterized as comprising at least one surface active compound which, when included in a motor fuel, is effective to inhibit solid contaminants e.g., air borne or fuel borne dirt and/or other solid contaminants in either the fuel composition or the combustion air, from adhering to metallic surfaces of engine components, e.g., carburetors. Although both ash-containing, metal-based detergents and ashless detergents are useful in the present motor fuel compositions, the ashless detergents are preferred. Often, the amount of detergent present in the compositions of the present invention is such that the weight ratio of aromatic-rich mineral oil fraction to detergent is in the range from about 1:1 to about 20:1, preferably from about 3:1 to about 20:1 and more preferably from about 5:1 to about 12:1.

There are many examples of ash-containing, metal-based detergents which are suitable for the present motor fuel compositions. Included among these ash-containing detergents are the metal organo phosphates of U.S. Pat. No. 3,751,235. Descriptions of other suitable ash-containing detergents may be found in other U.S. Patents, for example, U.S. Pat. Nos. 3,083,223, 2,956,869; 3,011,881; and 3,011,880.

It is preferred that the detergents used in the motor fuel compositions of the present invention be ashless in nature. In general, the ashless detergents preferred for use are compounds which comprise an oil-solubilizing tail and a polar detergent head. Many ashless detergents fitting this general description are known to the art and are commercially available.

Specific examples of this type of ashless detergent include the polyamino-polyalkylene alkenyl succinimides and the N-dialkylaminoalkyl alkenyl succinimides. Amine salts of alkyl phosphoric acids, are also suitable. Polyamine derivatives of long chained hydrocarbons may also be used. Reaction products of alkylene polyamines with long chained alkenyl succinic anhydrides and long chained esters of Mannich bases are suitable detergents. As can be seen, the required polarity may be supplied by groups containing, for example, oxygen, sulfur, phosphorous, nitrogen and mixtures thereof. All of these suitable ashless detergents may be generally characterized as compounds comprising at least one substantially hydrocarbon portion of sufficient size to render the compound oil-soluble and at least one non-metallic polar portion which when attached to the hydrocarbon portion provides a substantial part, often essentially all, of the detergent action.

To illustrate, specific examples of ashless detergents suitable for use include polyamino-polyalkylene alkenyl succinimides, long chain polyamines, dihydrocarbon substituted polyamines, substituted-phenol substituted polyamine products and mixtures thereof. These compounds may be represented by the following structures:

Polyamino-Polyalkylene alkenyl succinimides

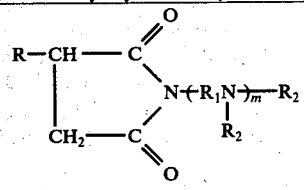

Long Chain Polyamines

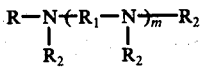

Dihydrocarbon Substituted Polyamines

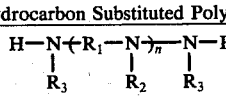

Substituted Phenol-Substituted Polyamine Products

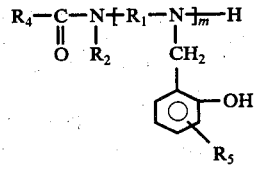

wherein R is a substantially hydrocarbon monovalent radical containing from about 30 to about 250 carbon atoms; each $R_1$ is an independently selected substantially hydrocarbon divalent radical containing from 1 to about 8 carbon atoms; each $R_2$ is independently selected from the group consisting of H and substantially hydrocarbon monovalent radicals containing from 1 to about 8 carbon atoms; each $R_3$ is an independently selected substantially hydrocarbon monovalent radical containing from about 15 to about 100 carbon atoms; $R_4$ is a substantially hydrocarbon monovalent radical containing from 2 to about 30 carbon atoms; each $R_5$ is an independently selected substantially hydrocarbon monovalent radical containing from about 4 to about 30 carbon atoms; *m* is an integer from 1 to about 10, preferably from 2 to about 10, and *n* is an integer from zero to about 10, preferably from about 2 to about 6.

It is preferred that R and $R_3$ be alkenyl, preferably selected from the group consisting of polypropenyl and polyisobutenyl. It is preferred that each $R_1$ be an independently selected alkylene radical containing from 1 to about 8, more preferably from 2 to about 6, carbon atoms. Suitable alkylene radicals from which each $R_1$ may be independently selected include methylene, ethylene, propylene, butylene, hexylene, octylene and the like. Although each $R_1$ may be independently selected, it is preferred that for any given ashless detergent all the $R_1$'s contained therein are the same radicals.

The substantially hydrocarbon monovalent radicals from which each $R_2$ may be independently selected each contain from 1 to about 8, preferably from 1 to about 4, carbon atoms. These substantially hydrocarbon radicals include alkyl, such as methyl, ethyl, propyl, butyl, hexyl, octyl and the like, alkenyl, such as ethenyl, propenyl, butenyl, hexenyl, octenyl and the like; aryl, alkaryl, aralkyl, alkenaryl and aralkenyl, such as phenyl, methyl phenyl, phenyl ethyl, ethenyl phenyl, phenyl ethenyl and the like.

The substantially hydrocarbon radicals from which $R_4$ is selected contain from 2 to about 30, preferably from about 4 to about 24, carbon atoms. These radicals may be straight chain or branched, saturated or unsaturated, aliphatic (including cycloaliphatic), aromatic or combinations thereof. Examples of suitable radicals include alkyl such as butyl, octyl, decyl, dodecyl, octadecyl, $C_{24}$ alkyl and the like; alkenyl such as butenyl, octenyl, dodecenyl, octydecenyl, $C_{24}$ alkenyl and the like; and aryl, alkaryl, aralkyl, alkenaryl, aralkenyl such as phenyl, benzyl, naphthyl, ethyl phenyl, decyl phenyl, octadecyl phenyl, phenyl butyl, phenyl decyl, phenyl octadecyl, butenyl phenyl, decenyl phenyl, octadecenyl phenyl, phenyl butenyl, phenyl decenyl, phenyl octadecenyl and the like. More preferably, $R_4$ is selected from the group consisting of alkyl and alkenyl containing from about 10 to about 24 carbon atoms.

Each $R_5$ is preferably independently selected from alkyl radicals containing from 4 to about 30, preferably from about 8 to about 20, carbon atoms. Examples of radicals from which each $R_5$ may be independently selected include amyl, octyl, decyl, octadecyl and the like. The

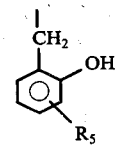

portion of the substituted phenol substituted polyamine acid salts may be replaced by, for example, alkylnaphthols and similar derivatives of biphenyl, terphenyl, phenanthrene, anthracene and the like.

The term "substantially" hydrocarbon radicals referred to about includes those radicals which are composed primarily of carbon and hydrogen and also includes radicals which contain, in addition, minor amounts of substituents such as oxygen, halide, sulfur, nitrogen and the like which do not substantially affect the hydrocarbon character of the radicals.

The specific ashless detergents noted above, as well as other of the many suitable ashless detergent materials and methods for preparing these materials are described in the following U.S. Pat. Nos. 3,236,614; 3,018,247; 3,513,093; 3,753,670; 3,008,993; 3,275,554; 3,573,011; 3,574,576; 3,576,743; 3,578,422; 3,597,174; 3,639,110; 3,652,240; 3,655,351; 3,658,494; 3,658,495; 3,676,089; 3,701,640; 3,711,255; 3,717,447; 3,728,091; 3,746,520; 3,751,255; 3,756,793; 3,762,889; 3,764,281; 3,765,850; 3,773,479; 3,752,657; 3,753,670; 3,779,724 and 3,782,912.

The base fuel of the invention comprises a mixture of hydrocarbons boiling in the gasoline boiling range. Typically, the base fuel comprises hydrocarbons which boil primarily in the range from about 50° to about 500° F. This base fuel may consist of straight chain or branched chain paraffins, cyclo-paraffins, olefins and aromatic hydrocarbons or any mixture of these. This fuel can be derived from straight run naphtha, polymer gasoline, natural gasoline or from catalytically cracked or thermally cracked hydrocarbons and catalytically reformed stocks. The composition of the base fuel is not critical nor does the octane level of the base fuel have any substantial material effect on the invention. Any conventional motor fuel base may be employed in the practice of this invention.

The base fuel may contain any of the additives normally employed in a motor fuel. For example, the base fuel may contain an anit-knock compound, such as a tetralkyllead compound including tetraethyllead, tetramethyllead, tetrabutyllead, mixtures thereof and the like. The tetraalkyllead mixture commercially available for automotive use contains an ethylene chloride-ethylene bromide mixture as a scavenger for removing lead from the combustion chamber in the form of a volatile lead halide. The tetraalkyllead mixtures are generally employed in gasoline in a concentration ranging from about 0.3 to 4.0 cc. of the mixtures per gallon of gasoline. Other conventional additives may also be included, for example, anti-icing agents, demulsifiers, corrosion inhibitors, dyes, deposit modifiers, multipurpose additives and the like.

The following examples illustrate clearly the present invention. However, these examples are not to be interpreted as specific limitations on the invention.

EXAMPLES 1 to 7

These examples illustrate certain of the advantages of the present invention.

A series of seven motor fuel compositions were prepared by thoroughly blending each of the components to insure a uniform composition. These compositions were as follows:

| Component* | COMPOSITION (1) 1 | 2 | 3 | 4 | 5 | 6 | 7 |
|---|---|---|---|---|---|---|---|
| Aromatic-rich Mineral Oil (I) (2) | — | 208 | — | 208 | — | 208 | — |
| Detergent (I) (3) | — | — | 18.6 | 18.6 | — | — | — |
| Detergent (II) (4) | — | — | — | — | 35 | 57 | 57 |
| Naphthene-rich Mineral Oil (I) (5) | — | — | — | — | — | — | 208 |

*The concentration of each of the components is given in pounds of component per thousand barrels of fuel composition.

(1) Each of the compositions, except for the components listed, is a base gasoline, i.e., unleaded blend of hydrocarbons boiling in the gasoline range having a research octane number clear of about 93. Composition 1, which includes no additional components, is totally this base gasoline.

(2) A mineral oil fraction derived from phenol extraction of a petroleum based deasphalted gas oil. This fraction has a viscosity of about 210 SUS at 210° F. and includes about 67% by weight of aromatic hydrocarbon components having an average molecular weight of about 430.

(3) A commercially available ashless detergent. A mixture comprising about 67% by weight of nitrogen containing component in a neutral hydrocarbon carrier. This mixture contains about 1.6% by weight of basic nitrogen and has a total base number (ASTM Test D-664) of about 64. The nitrogen-containing component is believed to comprise polyamine containing 2 to 3 basic nitrogen atoms bridged by hydrocarbon radicals containing about 2 to 4 carbon atoms per radical, and a hydrocarbon portion of sufficient size to render the nitrogen-containing component oil soluble. In addition, the nitrogen-containing component is believed to include at least one amide group. The mixture also includes a minor amount of demulsifier.

(4) A commercially available ashless detergent. A mixture comprising about 50% by weight of nitrogen-containing component in a neutral mineral oil carrier. This mixture contains about 1.4% by weight of nitrogen and has a total base number (ASTM Test D-664) of 10.7. The nitrogen-containing component is believed to include a hydrocarbon olefin polymer portion of sufficient size to provide oil solubility and an olefinic amine portion to provide a substantial part of the detergent action. This nitrogen-containing component has an average molecular weight of about 964. The mixture also includes a demulsifier and a corrosion inhibitor.

(5) A petroleum derived mineral oil fraction having a viscosity of about 90 SUS at 210° F. This fraction includes about 42% by weight naphthenic hydrocarbons and may be classified as a naphthene-rich mineral oil. The average molecular weight of the components in this fraction is about 450.

Each of these compositions were tested using the following procedure. A Ford prototype engine, having a displacement of 351 cu. in., was used in the testing. This engine employed exhaust gas recycle. The exhaust gas entered the carburetion system up-stream of the throttle plate through a non-cooled spacer. The rate of exhaust gas recycle was about 18% when the engine was operated at the equivalent of 50 miles per hour. During the test, the engine was operated at the following conditions:

Cyclic Operation — 5 Mode, 70 MPH Maximum, 50 MPH Average, 30 Minute Duration

Temperature of Recycle Exhaust at Point of Entry Into Spacer: 490°-650° F.

carburetor Base Temperature: 155°-175° F.

Engine Oil: Commercially available premium multigrade lubricating oil.

Test Duration: 25 hours

Rate of Fuel Consumption During Test: 4 Gal./hr.

After the engine is operated through the above cycle, visual inspections of the spacer through which exhaust gas is recycled were performed to determine the cleanliness of this spacer component. The spacer was rated from 0 to 10 based upon increasing cleanliness. Results of this test procedure with each of the compositions described above, were as follows:

| Composition | 1 | 2 | 3 | 4 | 5 | 6 | 7 |
|---|---|---|---|---|---|---|---|
| Visual Cleanliness rating of spacer | 4.8 | 8.1 | 2.7 | 8.4 | 5.2 | 9.2 | 5.8 |

These results indicate quite clearly that the present compositions (illustrated by Compositions 4 and 6) which include both a detergent and an aromatic-rich mineral oil provide improved inhibition to deposit formation on the carburetor and associated components of an internal combustion engine. For example, these compositions provide superior spacer cleanliness ratings relative to compositions which contain no additives (Composition 1) or compositions which contain only the detergent (Composition 3) or only the aromatic rich mineral oil (Composition 2). In addition, the present compositions provide improved spacer cleanliness ratings relative to compositions which contain a detergent and a naphthene-rich mineral oil (Composition 7).

EXAMPLES 8 to 11

These examples further illustrate certain advantages of the present invention.

A second series of four motor fuel compositions were prepared by thoroughly blending each of the components to insure a uniform composition. Unless otherwise specified, the components of these compositions are the same as those described in Examples 1 to 7. These four compositions were as follows:

| | COMPOSITION (6) | | | |
|---|---|---|---|---|
| Component* | 8 | 9 | 10 | 11 |
| Aromatic-Rich Mineral Oil (I) | — | 160 | — | — |
| Aromatic-Rich Mineral Oil (II)(7) | — | — | 160 | — |
| Naphthene-rich Mineral Oil (I) | — | — | — | 160 |
| Detergent (III) (8) | — | 35 | 35 | 35 |

*The concentration of each of the components is given in pounds of component per thousand barrels of fuel composition.

(6) Each of the compositions, except for the components listed, is a base gasoline, i.e., unleaded blend of hydrocarbons boiling in the gasoline range having a research octane number clear of about 91. Composition 8, which includes no additional component, is totally this base gasoline.

(7) A mineral oil fraction derived from phenol extraction of a petroleum based deasphalted gas oil. This fraction has a viscosity of about 750–800 SUS at 210° F. and includes about 63% by weight of aromatic hydrocarbon components having an average molecular weight of about 580.

(8) A commercially available ashless detergent. A mixture comprising about 50% by weight of nitrogen-containing component in a neutral mineral oil carrier. This mixture contains about 1.1% by weight of nitrogen and has a total base number (ASTM Test D-664) of 6.2. The nitrogen-containing component includes a hydrocarbon olefin polymer portion of sufficient size to provide oil solubility and a succinimide and/or succinamide portion to provide a substantial part of the detergent action. The mixture also includes a demulsifier and a corrosion inhibitor.

Each of these four compositions were tested using the following procedure which is known to give a reasonably accurate correlation with the deposit forming tendencies of fuel compositions. This test procedure is as follows: A supply of fuel composition combined with air to provide a spray which was caused to impinge upon an aluminum specimen. The fuel was metered at a rate such that about 100 ml./90 mins. flows through the nozzle. The air rate to this nozzle was set at 25 s.c.f./hr. The air pressure up-stream of the nozzle was set at 10 psig. The specimen, which comprised an aluminum tube was weighed to the nearest 0.0001 gm. An electrical heater and thermocouple were inserted into the specimen tube and this combination set near the outlet of the nozzle. The heater was turned on and controlled so that the thermocouple gave a reading of 475° plus or minus 5° F. The fuel and air were sent to the nozzle as described above. After 90 minutes, the fuel flow was stopped and the heater turned off and specimen allowed to cool. The cooled specimen was soaked in heptane for about 5 to 10 minutes and was then gently rinsed in heptane. The washed specimen, in a beaker, was placed in a vacuum oven for about 2 hours at 100° C. The specimen was then allowed to cool in a dessicator. After this cooling, the specimen was weighed and the resulting weight compared with the weight of the specimen prior to the test. By difference, the weight of the material deposited on the specimen during the test procedure was determined. This deposit weight was adjusted for the actual amount of fuel composition used so that a standard weight measure of mgs./100 ml. of fuel composition could be used for comparative purposes.

Results of the test procedure on these four motor fuel compositions were as follows:

| | Composition | | | |
|---|---|---|---|---|
| | 8 | 9 | 10 | 11 |
| Deposit Wt.-Mgs./100 ml. of Fuel composition | 4.3 | 1.8 | 0.9 | 3.6 |

These results demonstrate the unxpectedly reduced deposit forming tendencies of the present compositions. Thus, the compositions of the present invention (Compositions 9 and 10) exhibit reduced deposit formation relative not only to the base fuel (Composition 8), but also to the composition containing a naphthene-rich mineral oil in place of the aromatic rich oil fraction (Composition 11).

While this invention has been described with respect to various specific examples and embodiments, it is to be understood that the invention is not limited thereto and that it can be variously practiced within the scope of the following claims.

The embodiments of the invention in which an exclusive property or privilege is claimed are defined as follows:

1. A composition of matter for fueling an internal combustion engine equipped with at least one carburetor which comprises a major amount of hydrocarbons boiling in the gasoline boiling range, a minor amount of at least one detergent comprising at last one surface active compound effective to inhibit solid contaminants in said fuel composition from adhering to said carburetor and a minor amount of mineral oil of lubricating viscosity comprising at least about 50% by weight of aromatic hydrocarbons having an average molecular weight in the range from about 300 to about 700, said detergent and oil both being present in said composition in amounts sufficient to inhibit formation of deposits on said carburetor.

2. The composition of claim 1 wherein said mineral oil is present in an amount of at least about 50 pounds of oil per 1000 barrels of composition and the weight ratio of said mineral oil to said detergent is in the range from about 1:1 to about 20:1.

3. The composition of claim 2 wherein aid mineral oil has a viscosity in the range from about 50 SUS to about 3200 SUS at 210° F. and is present in an amount from about 100 to about 1000 pounds of oil per 1000 barrels of composition.

4. The composition of claim 3 wherein said detergent is ashless and comprises at least one compound having at least one substantially hydrocarbon portion of sufficient size to render the compound oil soluble and at least one non-metallic polar portion which when attached to said hydrocarbon portion provides a substantial part of the detergent action.

5. The composition of claim 4 wherein the weight ratio of said mineral oil to said detergent is in the range from about 3:1 to about 20:1.

6. The composition of claim 5 wherein said mineral oil has a viscosity in the range from about 65 SUS to about 1000 SUS at 210° F. and the aromatic components of said mineral oil have an average molecular weight in the range from about 350 to about 650.

7. The composition of claim 6 wherein said mineral oil is present in an amount from about 150 pounds to about 400 pounds of oil per 1000 barrels of composition.

8. The composition of claim 7 wherein the weight ratio of said mineral oil to said detergent is in the range from about 5:1 to about 12:1.

9. The composition of claim 4 wherein said detergent is selected from the group consisting of

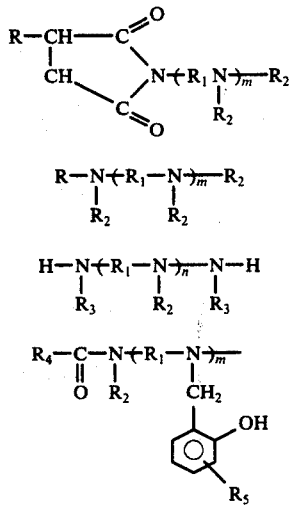

and mixtures thereof, wherein R is a substantially hydrocarbon monovalent radical containing from about 30 to about 250 carbon atoms, each $R_1$ is an independently selected substantially hydrocarbon divalent radical containing from 1 to about 8 carbon atoms, each $R_2$ is independently selected from the group consisting of H and substantially hydrocarbon monovalent radicals containing from 1 to about 8 carbon atoms, each $R_3$ is an independently selected substantially hydrocarbon radical monovalent radical containing from about 15 to about 100 carbon atoms, $R_4$ is a substantially hydrocarbon monovalent radical containing from 2 to about 30 carbon atoms, each $R_5$ is an independently selected substantially hydrocarbon monovalent radical containing from about 4 to about 30 carbon atoms, *m* is an integer from 1 to about 10, and *n* is an integer from zero to about 10.

10. The composition of claim 9 wherein the weight ratio of said mineral oil to said detergent is in the range from about 3:1 to about 20:1.

11. The composition of claim 10 wherein R and $R_3$ are alkenyl, each $R_1$ is an independently selected alkylene radical containing from 1 to about 8 carbon atoms, each $R_2$ is independently selected from the group consisting of H and hydrocarbon radicals containing from 1 to about 4 carbon atoms, $R_4$ contains from about 4 to about 24 carbon atoms, $R_5$ is alkyl containing from about 8 to about 20 carbon atoms, *m* is an integer from 2 to about 10, an *n* is an integer from about 2 to about 6.

12. The composition of claim 10 wherein said mineral oil has a viscosity in the range from about 65 SUS to about 1000 SUS at 210° F., the aromatic components of said mineral oil having an average molecular weight in the range from about 350 to about 600, said mineral oil is present in an amount from about 150 to about 300 lbs. of oil per 1000 barrels of composition and the weight ratio of said mineral oil to said detergent is in the range from about 5:1 to about 12:1.

13. The composition of claim 11 wherein said mineral oil has a viscosity in the range from about 65 SUS to about 1000 SUS at 210° F. and the aromatic components of said mineral oil have an average molecular weight in the range from about 350 to about 650.

14. The composition of claim 12 wherein said mineral oil is present in an amount from about 150 to about 400 pounds of oil per 1000 barrels of composition.

15. The composition of claim 13 wherein the weight ratio of said mineral oil to said detergent is in the range from about 5:1 to about 12:1.

16. In a method for operating an internal combustion engine equipped with at least one carburetor, the improvement which comprises fueling said engine with the composition of claim 1.

17. In a method for operating an internal combustion engine equipped with at least one carburetor, the improvement which comprises fueling said engine with the composition of claim 3.

18. In a method for operating an internal combustion engine equipped with at least one carburetor, the improvement which comprises fueling said engine with the composition of claim 4.

19. In a method for operating an internal combustion engine equipped with at least one carburetor, the improvement which comprises fueling said engine with the composition of claim 8.

20. In a method for operating an internal combustion engine equipped with at least one carburetor, the improvement which comprises fueling said engine with the composition of claim 9.

21. In a method for operating an internal combustion engine equipped with at least one carburetor, the improvement which comprises fueling said engine with the composition of claim 12.

22. In a method for operating an internal combustion engine equipped with at least one carburetor, the improvement which comprises fueling said engine with the composition of claim 15.

* * * * *